United States Patent [19]

Van Amburg

[11] 4,152,996

[45] May 8, 1979

[54] METHOD FOR SEWING TROUSER-FLY UNITS AND THE LIKE

[75] Inventor: William F. Van Amburg, Meadville, Pa.

[73] Assignee: Textron Inc., Providence, R.I.

[21] Appl. No.: 768,359

[22] Filed: Feb. 14, 1977

[51] Int. Cl.[2] ..... D05B 19/00; D05B 1/08; D05B 69/10

[52] U.S. Cl. ..... 112/262.3; 112/121.11; 112/162; 112/167; 112/272

[58] Field of Search ..... 112/262, 265, 121.11, 112/121.12, 121.15, 162, 163–167, 139, 208, 272

[56] References Cited

U.S. PATENT DOCUMENTS

| | | | |
|---|---|---|---|
| 426,256 | 4/1890 | Fefel | 112/139 X |
| 3,246,620 | 4/1966 | Sigoda et al. | 112/163 X |
| 3,339,507 | 9/1967 | Taketomi | 112/167 X |
| 3,353,510 | 11/1967 | Reeber et al. | 112/163 X |

FOREIGN PATENT DOCUMENTS

| | | | |
|---|---|---|---|
| 2221944 | 11/1974 | France | 112/163 |
| 2275164 | 1/1976 | France | 112/121.15 |

*Primary Examiner*—H. Hampton Hunter
*Attorney, Agent, or Firm*—O'Brien & Marks

[57] ABSTRACT

Trouser-fly pieces are sewn to a continuous slide fastener chain and at the same time are surged along a curved edge. Variable spacing between the surged curved edge and the line or lines of stitches sewing the fly pieces to the fastener chain is made by selective puckering of each fly piece between two sewing mechanisms. The trailing end of each fly piece is lifted during the sewing to permit the positioning of the next fly piece against a stop.

5 Claims, 8 Drawing Figures

FIG. 5
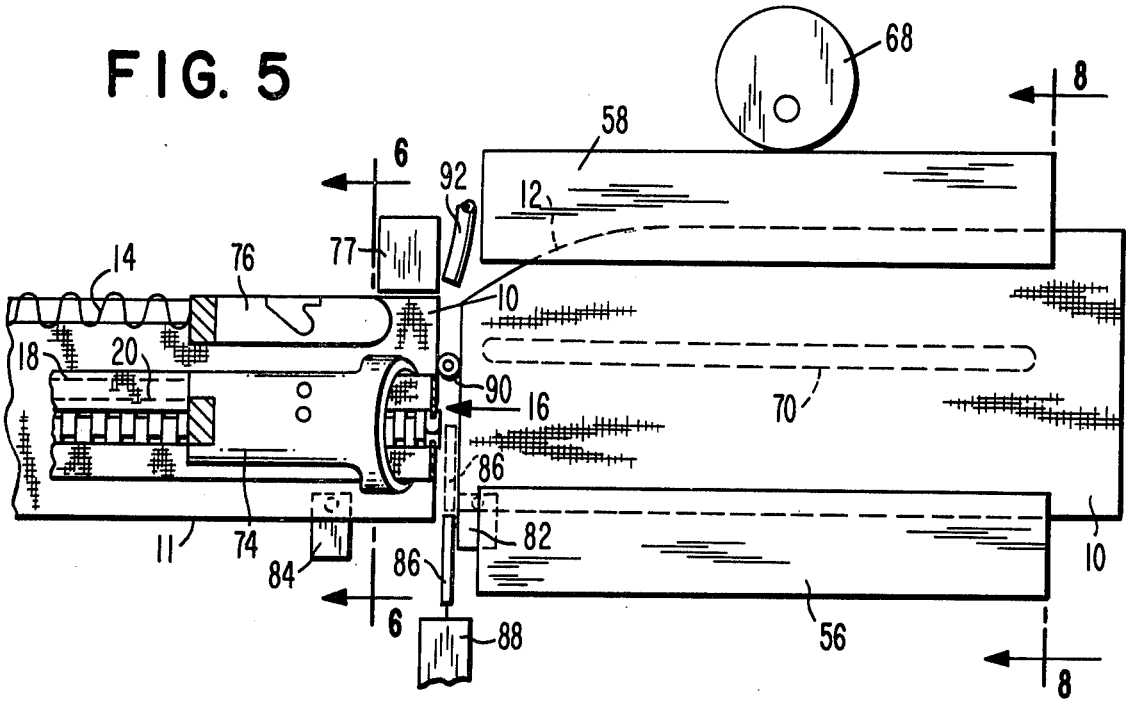
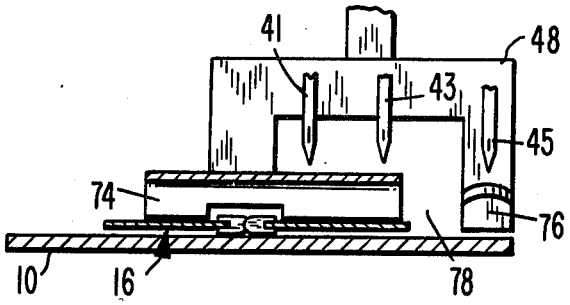
FIG. 6
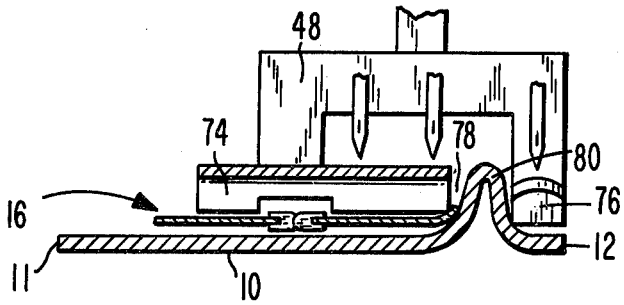
FIG. 7
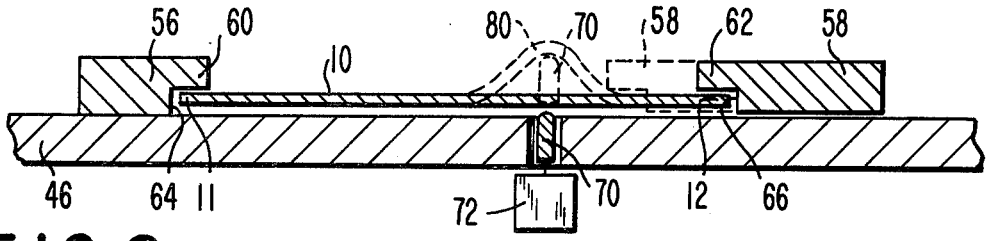
FIG. 8

METHOD FOR SEWING TROUSER-FLY UNITS AND THE LIKE

BACKGROUND OF THE INVENTION

1. Field of the Invention

This invention relates to methods and apparatus for assembling articles such as trouser-fly units.

2. DESCRIPTION OF THE PRIOR ART

The prior art, as exemplified in U.S. Pat. Nos. 2,697,227, 2,731,643, 3,263,238, 3,570,104, and 3,765,348 contains a number of apparatus and methods for producing trouser-fly units. In one method and apparatus as illustrated in the above mentioned U.S. Pat. Nos. 2,731,643 and 3,263,238 continuous strips of trouser-fly material are sewn to the tapes of continuous slide fastener chains and are surged; this method requires the added expense of a continuous length of fly material whereas it is more economical to use fly pieces cut from short lengths of scrap material. In the above mentioned U.S. Pat. Nos. 2,697,227, 3,570,104 and 3,765,348 individual fly pieces are sewn to a continuous slide fastener chain; however, these methods and apparatus cannot be used upon fly pieces which have a curved edge which is to be surged.

There are a number of prior art sewing machines such as that described in U.S. Pat. No. 2,973,732, which contain both an overedge stitching mechanism and a straight line stitching mechanism for simultaneously surging the edge of an article and sewing a line of stitches on an article; some of such prior art sewing machines having been employed in simultaneous surging of an edge of a fly piece and sewing the fly piece to a continuous slide fastener chain.

SUMMARY OF THE INVENTION

The invention is summarized in a method of simultaneously sewing two separate lines of stitches on an article with variable spacing between the lines of stitches including the steps of advancing the article through a sewing machine having two sewing mechanisms which are spaced apart transversely relative to the direction of advancement of the article to produce two separate lines of stitches on the article, and selectively puckering the article between the two sewing mechanisms so as to vary the spacing between the two lines of stitches on the article.

An object of the present invention is to provide a method and apparatus for producing garment units, such as trouser-fly units of the type used in dungarees, blue jeans, work pants, overalls, etc., with increased speed and efficiency.

Another object of the invention is to provide for the simultaneous surging of a curved edge of a trouser-fly piece and the sewing of the trouser-fly piece to a continuous slide fastener chain.

It is still another object of the invention to provide for aiding an operator in feeding fly pieces to a sewing machine.

One advantage of the invention is that selective puckering of an article, such as a trouser fly piece, between two stitching mechanisms, such as a straight line stitching mechanism and a surging mechanism, permits selective variation of the spacing between the two lines of stitching being formed simultaneously on the article.

In another feature of the invention, the trailing edge of a preceding fly piece is lifted so that the leading edge of the succeeding fly piece may be positioned for feeding into the sewing machine without waiting for the trailing edge of the preceding fly piece to move past the positioning point.

Other objects, advantages and features of the invention will be apparent from the following description of the preferred embodiment taken in conjunction with the accompanying drawings.

BRIEF DESCRIPTION OF THE DRAWINGS

FIG. 5 is a plan view of the apparatus portion of FIG. 4.

FIG. 6 is a cross-sectional view taken at line 6—6 of FIG. 5.

FIG. 7 is a view similar to FIG. 6 but at later step in the assembly of a trouser-fly unit.

FIG. 8 is a cross-sectional view taken at line 8—8 in FIG. 5.

DESCRIPTION OF THE PREFERRED EMBODIMENT

Figure 1:
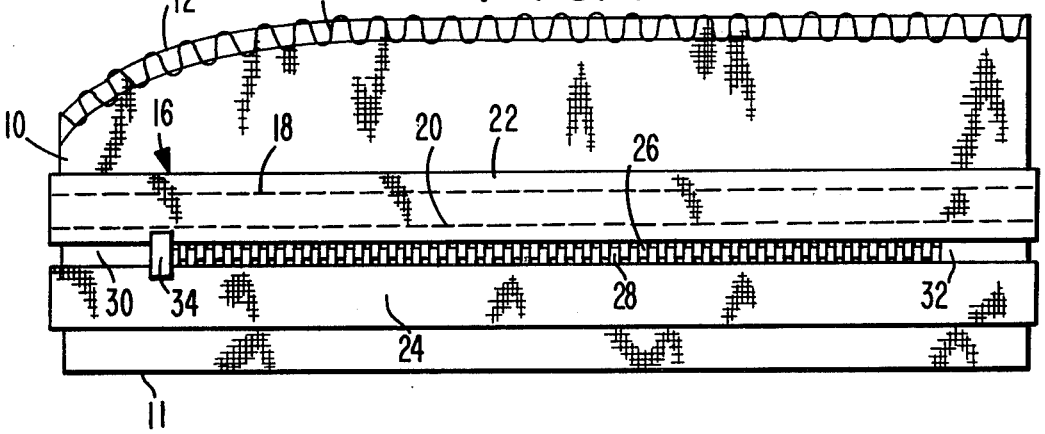
FIG. 1 is a plan view of a trouser-fly unit manufactured in accordance with the present invention.

As illustrated in FIG. 1, a trouser-fly unit manufactured in accordance with the invention includes an elongated fly piece 10 having a straight side edge 11 and a curved edge 12 which is surged by a line of overedge stitches 14, and includes a slide fastener chain indicated generally at 16 which is sewn to the fly piece 10 by a pair of straight lines of stitches 18 and 20. The slide fastener chain 16 includes a pair of tapes 22 and 24 with respective rows of interengaging fastening elements 26 and 28 mounted on the inner edges thereof. The elements 26 and 28 are removed at both the top and bottom ends of the slide fastener chain 16 to form gaps 30 and 32 between the tapes 22 and 24. A bottom stop such as a conventional staple 34 is applied to one end of the rows of interengaging fastening elements 26 and 28 to secure the opposite tapes 22 and 24 or halves of the slide fastening chain together at that point.

Figure 2:
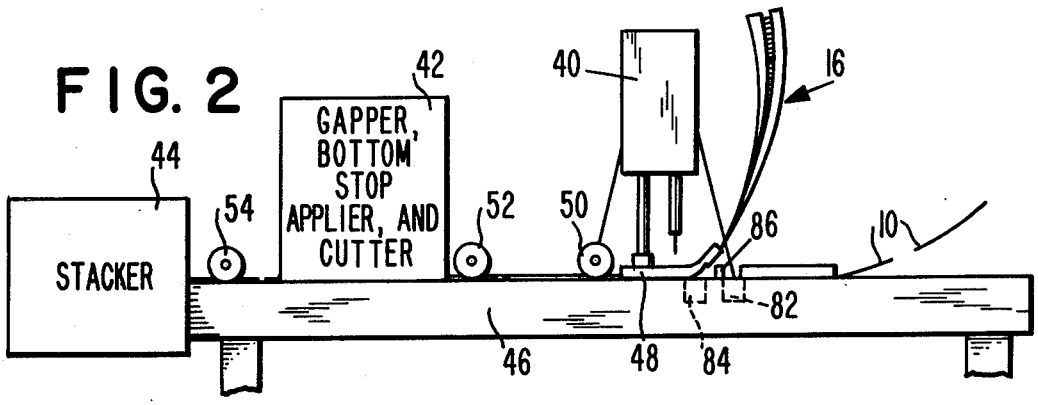
FIG. 2 is a side elevational view of an apparatus for manufacturing a train of the trouser-fly units of FIG. 1 in accordance with the invention.

An apparatus for manufacturing a plurality of the trouser-fly units of FIG. 1 is shown in FIG. 2 and includes a sewing machine 40; a gapper, bottom stop applier and cutter 42; and a stacker 44; all mounted on a suitable support such as a table top 46. The sewing machine 40 is a conventional sewing machine, except for a modified presser foot 48 as described herein, which includes at least two spaced sewing mechanisms, one including the needle 45, FIG. 6, and trimmer 77, FIG. 5, for forming the line of overedge stitches 14 and the other including the needles 41 and 43 for forming the lines of straight stitches 18 and 20. Alternately the sewing machine 40 can have a stitching mechanism with only one needle for forming a single line of straight stitches in place of the double line of stitches 18 and 20. The gapper, bottom stop applier and cutter 42 is a conventional apparatus or assembly of apparatus for forming the gaps 30 and 32, applying the bottom stops 34 and severing the continuous chain 16 between the fly pieces 10. The stacker 44 is a conventional mechanism for forming stacks of the fly units; alternately a receptacle or bin may be provided in place of the stacker 44 to receive a plurality of the trouser-fly units. Feed wheels 50, 52, and 54 are provided at the output of the sewing machine 40, at the input of the gapper, bottom stop applier and cutter 42, and between the gapper, bottom stop applier and cutter 42 and the stacker 44, respectively, for advancing the train of the trouser-fly units.

As shown in FIGS. 5 and 8, a pair of elongated parallel members 56 and 58 are mounted on the support 46 forming a pathway leading to the sewing mechanisms of the sewing machine 40, the member 56 being mounted stationary while the member 58 is mounted for sliding movement perpendicular to the pathway between the members 56 and 58 for the fly pieces 10. The members 56 and 58 have upper inward extending flanges 60 and 62 for cooperating with the table top 46 to form channels 64 and 66 for receiving the respective opposite edges 11 and 12 of the fly piece 10. Means such as a cam 68 is provided for moving the guide member 58 in synchronism with the operation of the sewing machine 40. Also a pucker assist bar 70 parallel and between the guide members 56 and 58 is mounted in the table top 46 for vertical movement into the pathway between the members 56 and 58; suitable moving means 72 operated in synchronism with the cam 68 is connected to the pucker assist bar 70.

The presser foot 48 has a slide fastener portion 74, see FIGS. 5, 6, and 7, and an overedge portion 76 which are spaced leaving a gap or channel 78 therebetween for receiving a longitudinal pucker or fold 80 in the fly piece 10. The slide fastener portion 74 is provided with conventional means, such as a loop and a fastener element channel in the sole thereof, for guiding the slide fastener chain while the overedge portion 76 is formed in a conventional manner to permit operation of the overedge stitching mechanism.

The moving means 68 and 72 for the respective member 58 and bar 70 are designed to move the member 58 and to raise bar 70 gradually and continuously in correspondence with the movement of the curved portion of the fly piece 10 to the sewing machine 40 such that the pucker 80 is gradually formed during this portion of movement of the flypiece 10 to maintain a predetermined spacing between the edge 12 and the slide fastener chain 16 as they pass through the stitching mechanisms of the sewing machine. The moving means 68 and 72 are designed to retract the member 58 and lower the bar 70 after the pucker 80 is formed.

Figure 4:
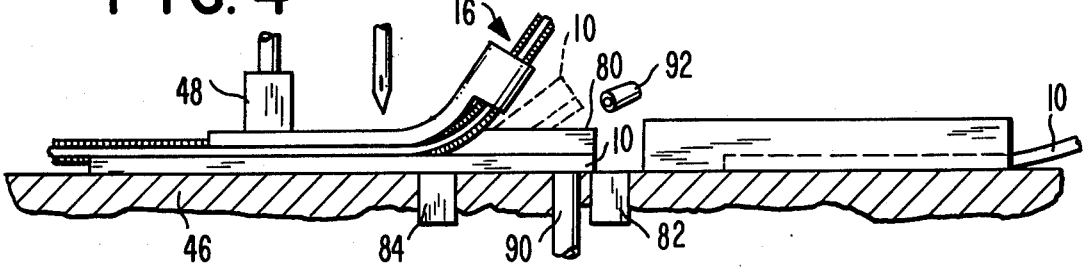
FIG. 4 is an enlarged side elevational view, partially in cross section, of a portion of the apparatus of FIG. 2.

A pair of sensors 82 and 84, as illustrated in FIGS. 2, 4 and 5, are mounted in the table top 46 beneath the path of the edge 11 of the fly piece 10 emerging from the guide member 56 and passing beneath the presser foot 48. The sensors 82 and 84 are positive air flow sensors, photoelectric cells, or any other suitable device for sensing the presence of the fly piece 10 and the end thereof. The sensor 82 is positioned before the sensor 84 in the path of the fly pieces 10. A stop 86 is movably mounted on the table top 46 for movement perpendicular to the path of the fly piece 10 between the presser foot 48 and the exit end of the guide members 56 and 58. The stop 86 is connected to a suitable moving mechanism 88 for advancing and retracting the stop 86 into and out of the path of the movement of the fly pieces 10. A vertical air jet tube 90 is provided beneath the path of the fly pieces 10 between the exit from the guide members 56 and 58 and the front of the presser foot 48, while a horizontal air jet tube 92 is positioned above the table top 46 and directed toward the presser foot 48 from the side of the pathway of the fly piece 10 between the presser foot 48 and the guide members 56 and 58. The sensors 82 and 84 are operatively connected to the air jets 90 and 92 and the stop moving means 88. Also the sensor 84 is operatively connected to the sewing machine 40.

Figure 3:
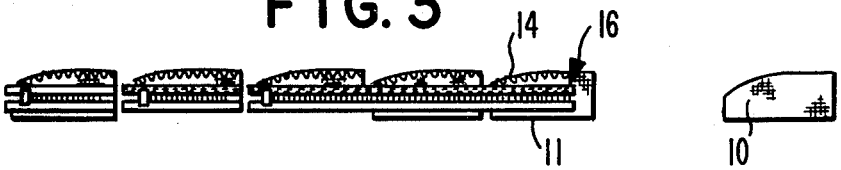
FIG. 3 is a plan view of a train of the units of FIG. 1 illustrating several steps of the manufacture.

In operation of the trouser fly unit making apparatus, as shown in FIGS. 2 and 3, the fly pieces 10 are fed to the sewing machine 40 with the continuous slide fastener chain 16 being superimposed thereon. The sewing machine 40 forms an overedge stitch 14 on the curved edge 12, FIG. 1, of the fly piece 10 and simultaneously sews the straight lines of stitches 18 and 20 securing the tap 22 of the slide fastener chain 16 to the fly piece 10. From the sewing machine 40 the train of fly piece units are advanced to the gapper, bottom stopper applier and cutter 42 where the gaps 30 and 32 are cut, the bottom stops 34 are applied, and the chain 16 is cut between the fly pieces 10 to form individual units. Subsequently the individual fly units are fed to the stacker 44 where they are stacked for subsequent use in the manufacture of garments.

Referring to FIGS. 4, 5, 6, 7 and 8, the fly pieces 10 are fed between the guide members 56 and 58 with the edges 11 and 12 of the fly piece 10 received in the respective channels 64 and 66 beneath the flanges 60 and 62 of the members 58 and 60. Initially the guide member 58 is in a retracted position, as shown in FIG. 5 to advance the narrow end of the fly piece 10 beneath the presser foot 48. As the fly piece 10 is advanced, the cam 68 rotates gradually through 180° to move the guide member 58 toward the other guide member 58 to push the edge 12 toward the edge 11 of the fly piece 10, and the pucker assist bar 70 is gradually raised by the raising means 72 to lift an intermediate portion of the piece 10 to form a longitudinal pucker or fold 80 in the fly piece 10. This pucker 80 is formed so as to maintain a predetermined spacing between the edges 11 and 12 of the piece 10 or between the edge 12 and the slide fastener chain 16 as they pass beneath the presser foot 48. The pucker 80 is received in the channel 78 in the presser foot 48 to thus allow the overedge line of stitches 14 to be formed on the curved edge 12 without changing the spacing between the overedge stitching mechanism and the straight line stitching mechanism of the sewing machine 40. Subsequently the cam 68 rotates through another 180° to retract the guide member 58 and the means 72 lowers the pucker assist bar 70.

After the trailing edge of a fly piece 10 has passed the sensor 82, the air jet 90 is activated for a short duration to raise the trailing end of the fly piece 10, as shown in phantom FIG. 4, and then the horizontal air jet 92 is activated to maintain the end of the fly piece raised. The stop advancing mechanism 88 is activated to move the top 86 into the path of the next fly piece 10 beneath the trailing end of the fly piece 10 being sewn and between the presser foot 48 and the guide members 56 and 58. This permits the operator to position the next fly piece 10 before the sewing of the preceding fly piece has been completed. The sensor 84 senses the passing of the end of the first fly piece to stop the sewing machine 40 and to operate the stop moving means 88 to retract the stop 86 as well as to deactivate the air jets 90 and 92 so that the operator may then advance the leading end of the next fly piece 10 beneath the presser foot 48. Another cycle of operation of the sewing mechanism can then be initiated in a conventional manner.

Since the present invention is subject to many modifications, variations and changes in detail, it is intended that all matter in the foregoing description or in the drawings be interpreted as illustrative and not in a limiting sense.

What is claimed is:

1. A method of simultaneously sewing two separate lines of stitches on an article with variable spacing between the lines of stitches, the method comprising the steps of advancing the article through a sewing machine having two sewing mechanisms which are spaced apart transversely relative to the direction of advancement of the article to produce two separate lines of stitches on the article, and selectively puckering the article between the two sewing mechanisms during the advancing of the article, said selectively puckering step including changing the size of the pucker during the advancing of the article so as to vary the spacing between the two lines of stitches on the article such that one of the two lines of stitches produced on the article is curved.

2. A method as claimed in claim 1 wherein the puckering step includes pushing one edge of the article toward the other edge of the article.

3. A method as claimed in claim 1 wherein the puckering step includes lifting a portion of the article from below to form a pucker.

4. A method of simultaneously sewing two separate lines of stitches on successively fed first and second articles with variable spacing between the lines of stitches, the method comprising the steps of successively advancing the articles through a sewing machine having two sewing mechanisms which are spaced apart transversely relative to the direction of advancement of the articles to produce two separate lines of stitches on the articles, selectively puckering the articles between the two sewing mechanisms so as to vary the spacing between the two lines of stitches on the articles, lifting the trailing end of the first article during the advancing of the first article through the sewing machine, and positioning the second article with the leading end of the second article beneath the raised trailing end of the first article being advanced.

5. A method of simultaneously sewing twc separate lines of stitches on articles with variable spacing between the lines of stitches, the method comprising the steps of advancing an article through a sewing machine having two sewing mechanisms which are spaced apart transversely relative to the direction of advancement of the article to produce two separate lines of stitches on the article, selectively puckering the article between the two sewing mechanisms so as to vary the spacing between the two lines of stitches on the article, sensing the trailing end of the article being advanced when it reaches a first position, lifting the trailing end of the article in response to the sensing at the first position, moving a stop beneath the lifted trailing end of the advancing article so that another article may be positioned against the stop, and sensing the trailing end of the advancing article at a second position advanced from said first position, and retracting the stop in response to said sensing at the second position.

* * * * *